United States Patent [19]

Takahashi et al.

[11] Patent Number: 4,649,095

[45] Date of Patent: Mar. 10, 1987

[54] COLOR DIFFUSION TRANSFER PHOTOGRAPHIC FILM UNIT CONTAINING ALUMINUM COMPOUND

[75] Inventors: Osamu Takahashi; Minoru Sakai, both of Kanagawa, Japan

[73] Assignee: Fuji Photo Film Co., Ltd., Kanagawa, Japan

[21] Appl. No.: 778,757

[22] Filed: Sep. 23, 1985

Related U.S. Application Data

[63] Continuation-in-part of Ser. No. 658,935, Oct. 9, 1984, abandoned.

[30] Foreign Application Priority Data

Oct. 6, 1983 [JP] Japan ..... 58-187405

[51] Int. Cl.[4] ..... G03C 5/54; G03C 7/00

[52] U.S. Cl. ..... 430/216; 430/214; 430/218

[58] Field of Search ..... 430/214, 216, 218, 219, 430/490, 491, 492

[56] References Cited

U.S. PATENT DOCUMENTS 3,594,165 7/1971 Rogers ..... 430/220
3,594,164 7/1971 Rogers ..... 430/220
3,619,155 11/1971 Young ..... 430/214
3,856,521 12/1974 Bilofsky et al. ..... 430/218

OTHER PUBLICATIONS

Barnett, "pH Buffer Compositions", *Research Disclosure,* No. 16156, 9/1977, p. 5.

*Primary Examiner*—Richard L. Schilling
*Attorney, Agent, or Firm*—Sughrue, Mion, Zinn, Macpeak & Seas

[57] ABSTRACT

A nonseparation monosheet integrated type color diffusion transfer photographic film unit is disclosed comprising (a) a light-sensitive element comprising a support having provided thereon in this order an image receiving layer, a white reflection layer and at least one silver halide emulsion layer associated with a dye providing compound capable of forming or releasing a diffusible dye as a result of development;
(b) a cover sheet;
(c) at least one neutralizing layer;
(d) a container provided between the emulsion layer of the light-sensitive element and the cover sheet, containing an alkali processing composition which contains an aluminum compound.

5 Claims, No Drawings

COLOR DIFFUSION TRANSFER PHOTOGRAPHIC FILM UNIT CONTAINING ALUMINUM COMPOUND

This is a continuation-in-part of application Ser. No. 658,935, filed Oct. 9, 1984, now abandoned.

FIELD OF THE INVENTION

The present invention relates to film units for a color diffusion transfer process. In greater detail, it relates to color diffusion transfer nonseparation monosheet integrated type photographic film units.

BACKGROUND OF THE INVENTION

Color diffusion transfer photographic film units are generally classified as either separation type or nonseparation type. The term "nonseparation" type film units mean those wherein the separation is not required. Separation type film units are described, for example, in U.S. Pat. No. 2,983,606. Nonseparation type film units are preferable in many applications, such as candid photogaphy, because the transfer images can be seen immediately with pleasure, and the disadvantages of the separation type film units (for example, dirtying of hands caused by processing solutions and litter caused by the separated part of the film unit are avoided. Nonseparation type film units are typically either (1) a unit in which an image receiving layer and a light-sensitive layer are applied to different supports and a processing solution is spread between the image receiving layer and the light-sensitive layer, and (2) a unit in which a processing solution is spread on a light-sensitive sheet composed of an image receiving layer and a light-sensitive layer applied on the same support. The former units are described, for example, in U.S. Pat. Nos. 3,415,645 and 3,415,646 and Japanese Patent Application (OPI) No. 327/72 (corresponding to U.S. Pat. No. 3,619,155) (the term "OPI", as used herein, refers to a "published, unexamined Japanese Patent Application"). The latter units are described, for example, in Japanese Patent Application (OPI) Nos. 60433/81, 157245/82, 157236/82 and 17435/83, U.S. Pat. Nos. 4,374,919 and 4,332,885, and British Pat. No. 1,330,524. In the nonseparation monosheet integrated type photographic film units of the latter type (2), development is started by spreading an alkali processing solution between the light-sensitive sheet and the cover sheet, and development is stopped by reducing the pH of the system by means of a neutralization mechanism in the light-sensitive sheet or the cover sheet, or by release of a development restrainer in the cover sheet. It is of course preferred that the diffusible dyes released as a result of development diffuse into the image receiving layer as quickly as possible to quickly conclude image formation.

On the other hand, after conclusion of development, it is preferred that the image is not changed by for example, a further increase of dye densities caused by additional diffusion of the dyes into the image receiving layer. Such film units are generally designed to provide the most suitable color balance and dye densities at the conclusion of development, and any change of color densities thereafter results in deterioration of image quality. Generally, in monosheet multicolor diffusion transfer film units of type (2), images appear within several seconds to several tens of seconds, and the image formation concludes after several minutes to at most 1 hour. However, in practice the problem of "post-transfer" is observed, i.e., the quality of images deteriorates after 1 hour, because dyes continue to gradually transfer over a period of one to several days.

Film units which solve the above described problem of post-transfer have been described in U.S. Pat. No. 3,730,718. In these film units, a light-shielding layer is provided between an image receiving layer and a light-sensitive element so that the film units after removal from the camera can be developed in the light after exposure. A releasing layer is provided between the light-sensitive element and an element containing the image receiving layer, so that these elements can be separated after development (i.e., as soon as sufficient transfer image densities are observed through a transparent support supporting the above described layers). These film units are essentially separation type film units because they require separation in order to prevent post-transfer, and they necessarily have the disadvantages associated with such separation units discussed above.

SUMMARY OF THE INVENTION

An object of the present invention is to provide a nonseparation monosheet integrated type color diffusion transfer photographic film unit which greatly reduces "post-transfer". This object has been effectively attained by a nonseparation monosheet integrated type color diffusion transfer photographic film unit comprising (a) a light-sensitive element comprising a support having provided thereon in this order an image receiving layer, a white reflection layer and at least one silver halide emulsion layer associated with a dye providing compound capable of forming or releasing a diffusible dye as a result of development;

(b) a cover sheet;

(c) at least one neutralizing layer present in the cover sheet or between the support of the light-sensitive element and the image receiving layer thereof); and (d) a container provided between the emulsion layer of the light-sensitive sheet and the cover sheet, containing an alkali processing composition which contains an aluminum compound.

DETAILED DESCRIPTION OF THE INVENTION

The aluminum compound used in the present invention is a compound which produces aluminic acid anions in the alkali processing composition having a high pH value, but produces aluminum cations with the nutralization of alkali. Examples of the aluminum compound include salts of an aluminum cation and a inorganic acid anion (such as a nitric acid anion, a sulfuric acid anion, a hydrochloric acid anion, or etc.), salts of an aluminum cation and an organic acid anion (such as a tartaric acid anion, an oxalic acid anion, a malonic acid anion, an acetic acid anion, a formic acid anion, or etc.), salts of an aluminic acid anion and an alkali metal cation (such as $Li^+$, $Na^+$, $K^+$, $Cs^+$, $Rb^+$, or etc.), and salts of an aluminic acid anion and an alkaline earth metal cation (such as $Mg^{2+}$, $Ca^{2+}$, $Ba^{2+}$, or etc.).

Preferred examples of the aluminum compound include aluminum nitrate, aluminum sulfate, aluminum acetate and sodium aluminate. The aluminum compound is preferrably used in an amount of about 0.4 g to 40 g and more preferably about 1 g to 20 g per Kg of the alkali processing composition.

The mechanism of the present invention is not clearly understand, but it is believed that the aluminum compound present in the form of aluminic acid anion in the alkaline processing composition produces aluminum cations with the neutralization of alkali in the latter period of development or after conclusion of development by the action of the alkali neutralizing layer.

It is estimated that the aluminum cations delay remarkably or prevents diffusion of dyes by some interaction with the dyes available to diffuse into the image receiving layer, so that undesirable diffusion of dyes after completion of images is reduced or substantially prevented.

Japanese Patent Application (OPI) No. 327/72 (corresponding to U.S. Pat. No. 3,619,155) relates to a film unit using dye providing compounds which are soluble and diffusible in a processing composition, and a processing composition containing a light-shielding agent in an amount sufficient to mask the dye providing compounds which is spread between the image receiving layer and the light-sensitive layer. A metal ion is provided in the image receiving layer or the processing composition and a specific film-forming polymer layer which causes cross-linkage with the metal ion is provided between the image receiving layer and the light-sensitive layer. Metal ions, including cadmium, magnesium, calcium, zinc, zirconium, aluminum, chromium and nickel are described. As specific film-forming polymers which cross-link with the metal ion after diffusion of the dye providing compounds into the image receiving layer, carboxymethyl cellulose and carboxymethyl hydroxyethyl cellulose are described. However, this film unit differs from the film unit of the present invention in the mechanism of image formation, because the alkali processing composition is spread between the image receiving layer and the light-sensitive layer, rather than between the light-sensitive layer and the cover sheet as in the present invention. Also, in the present invention, "post-transfer" can be effectively prevented by simply incorporating and aluminum compound in the alkali processing composition, without the use of a specific polymer, which is quite surprising from knowledge of the prior art.

*Research Disclosure* No. 16,156 (September 1977) discloses that, in producing color transfer images on the image receiving layer by a color diffusion transfer process, the light-sensitive sheet after exposure to light is processed by immersing it in an alkaline processing solution which is buffered with alkali metal salts of aluminic acid and dicarboxylic acids such as tartaric acid or salts thereof so as to have a pH of 11 to 12. The light-sensitive sheet is then superimposed on an image receiving sheet and both sheets are separated after 2 minutes. In this case, the aluminum compounds are used to buffer the processing solution and the color diffusion transfer process is essentially a separation process which is fundamentally different from the use of aluminum compounds to prevent "post-transfer" in film units of the present invention.

Dye providing compounds useful in the present invention are compounds which form or release a diffusible dye (or a precursor thereof) by an oxidation-reduction reaction or other reactions as a result of development, including diffusible dye releasing redox compounds (hereinafter, referred to as "DRR compound"), diffusible dye releasing couplers and dye developing agents. DRR compounds are preferred, and in the following examples, the use of DRR compounds is illustrated typically, but present invention is not limited thereto, and dye providing compounds can be similarly utilized.

The silver halide developing agent used in the present invention is generally incorporated in the alkali processing solution, but it is possible to incorporate the developing agent in at least one lyaer of the light-sensitive element if desired, or to incorporate it in both the alkali processing solution and the light-sensitive element. If incorporated in the light-sensitive element, it may be in the form of a precursor which forms a developing agent by decomposed under alkaline conditions.

Any conventional silver halide developing agent can be used, if an oxidation product of the developing agent can cause cross-oxidation of DRR compounds. Typical examples of such developing agents include 3-Pyrazolidinones, for example, 1-phenyl-3-pyrazolidinone, 4,4-dimethyl-1-phenyl-3-pyrazolidinone, 4-hydroxymethyl-4-methyl-1-phenyl-3-pyrazolidinone, 4-hydroxymethyl-4-methyl-1-tolyl-3-pyrazolidinone, 4-hydroxymethyl-4-methyl-1-(4'-methoxy)-3-pyrazolidinone, 4,4-bis(hydroxymethyl)-1-phenyl-3-pyrazolidinone, 4,4-bis(hydroxymethyl)-1-tolyl-3-pyrazolidinone, 4,4-bis(hydroxymethyl)-1-(4'-methoxy)-3-pyrazolidinone, 4,4-dimethyl-1-tolyl-3-pyrazolidinone and 1,5-diphenyl-3-pyrazolidinone; aminophenols, for example, p-aminophenol, p-methylaminophenol, p-dimethylaminophenol, p-dimethylaminophenol, p-dibutylaminophenol, p-piperidinoaminophenol and 4-dimethylamino-2,6-dimethoxyphenol; phenylenediamines, for example, N-methyl-p-phenylenediamine, N,N-dimethyl-p-phenylenediamine, N,N-diethyl-p-phenylenediamine, N,N,N',N'-tetramethyl-p-phenylenediamine and 4-diethylamino-2,6-dimethoxyaniline; and reductones, for example, piperidinohexose reductone and pyrrolidinohexose reductone. These developing agents may be used alone or in combination.

As alkaline substances in the alkali processing solution used in the present invention, compounds of alkali metals and other metals, for example, sodium hydroxide, potassium hydroxide, rubidium hydroxide and cesium hydroxide are used. Further, sodium carbonate and amines such as diethylamine can be used. The alkali processing solution preferably adjusted to a pH of above about 11 by incorporating these alkaline substances.

The alkali processing solution used in the present invention preferably contains a thickeners including ethers inactive to alkaline solutions such as hydroxyethyl cellulose or alkali metal salts of carboxymethyl cellulose (for example, sodium carboxymethyl cellulose). The amount of the thickeners added depends upon the agent selected or its degree of polymerization, but a concentration in a range of about 1 to 10% by weight based on the processing solution is advantageous. The viscosity of the alkali processing solution is preferably about 100 to 250,000 cps. Accordingly, polysaccharide gums such as guar gums, xanthanes and algins, described in *Research Disclosure* No. 15162 (November 1976), can be used as thickeners in addition to the above described thickeners.

U.S. Pat. No. 3,856,521 describes use of ethylene diamine tetraacetic acid in combination with aluminum ions to reduce the stain caused by a filter agent. The processing composition of the present invention is a filter agent-free processing composition, E.g., a filter agent as described in U.S. Pat. No. 3,856,521 is not used in the present invention. If a filter agent is present in the processing solution superfluous, unnecessary coloration would result before image formation. As a result, color contamination would result during the course of image completion (prior to and during the conclusion of image formation).

The light shielding agent used in the alkali processing solution in the present invention is not limited, and any conventional light shielding agents may be used, including, for example, carbon black, titanium dioxide and light absorbing dyes, such as, indicator dyes which change color according to pH.

Into the film units of the present invention, the following compounds are optionally incorporated, but they are preferably added to the alkali processing solution.

The film units of the present invention may contain additives to increase transfer image densities, such as benzyl alcohol disclosed in U.S. Pat. No. 3,846,129; aromatic alcohols such as p-xylene-$\alpha,\alpha'$-diol: aliphatic and alicyclic glycols and saturated aliphatic and alicyclic aminoalcohols disclosed in U.S. Pat. No. 4,030,920, for example, 1,4-cyclohexanedimethanol, 1,6-hexanediol, 3-amino-1-propanol, 2-amino-1-propanol, 5-amino-1-pentanol, 6-amino-1-hexanol and 2-amino-2-methyl-1-propanol.

The film units of the present invention may contain the compounds described in U.S. Pat. No. 3,942,987 which prevent generation of pimple-like deformations after substantial conclusion of development, for example, alkali metal fluorides and oxalates, and barium salts.

The film units of the present invention may contain compounds disclosed in U.S. Pat. No. 2,497,917, for example, 5-methylbenzotriazole, 5,6-dichlorobenzotriazole, 6-nitrobenzimidazole and histidine.

The alkali processing solution used in the present invention preferably contains uniformly dispersed pigments such as carbon black or titanium dioxide. In this case, known dispersing assistants and surface active agents can be used, including alkali metal salts of polyacrylic acid, naphthalene sulfonic acid, polycondensate of naphthalenesulfonic acid and formaldehyde, or polystyrenesulfonic acid. Particularly useful carbon black dispersions are those prepared by the process described in Japanese Patent Application (OPI) Nos. 52362/83 and 91162/84.

In order to render various impurities in the alkali processing solution substantially harmless to the silver halide emulsions, various compounds may be incorporated, including metal salts such as silver nitrate, silver oxide, lead oxide, tin oxide, cadmium oxide, zinc nitrate, zinc oxide and mercury oxide.

Light-sensitive silver halide emulsions used in the present invention are hydrophilic colloidal dispersions of silver chloride, silver bromide, silver chlorobromide, silver iodobromide, silver chloroiodobromide or a mixture thereof, in which the halogen composition is selected according to the use of the light-sensitive materials and the processing condition employed. Silver bromide, silver iodobromide and silver chloroiodobromide which have an iodide content of 10 mole % or less and a chloride content of 30 mole % or less are particularly preferred.

In the present invention, negative emulsions forming surface latent images and direct reversal emulsions can be used. Useful direct reversal emulsions, include inner latent image emulsions and previously fogged direct reversal emulsions.

In the present invention, inner latent image direct reversal silver halide emulsions can be advantageously used. Examples of such emulsions include conversion type emulsions, core/shell type emulsions and metal dopant emulsions, described in U.S. Pat. Nos. 2,592,250, 3,206,313, 3,447,927, 3,761,276 and 3,935,014.

Examples of typical nucleating agents used in emulsions of this type include hydrazines described in U.S. Pat. Nos. 2,588,982 and 2,563,785; hydrazides and hydrazones described in U.S. Pat. No. 3,227,552; quaternary salt compounds described in British Pat. No. 1,283,835, Japanese Patent Publication No. 38164/74 and U.S. Pat. Nos. 4,115,122, 3,734,738, 3,719,494 and 3,615,615; sensitizing dyes having a substituent having a fogging (nucleating) function in the dye molecule, described in U.S. Pat. No. 3,718,470; and acylhydrazine compounds having a thiourea group described in U.S. Pat. Nos. 4,030,925; 4,031,127, 4,245,037, 4,255,511, 4,266,013 and 4,276,364.

DRR compounds suitably used in the present invention are immobile under alkaline processing conditions and can be represented by the following formula.

(Ballast)-(Link)-(Dye) (I)

In the formula, (Ballast) represents a ballast group for immobilizing the DRR compound even under alkaline processing conditions, (Dye) represents a dye group or a precursor thereof which is diffusible in the light-sensitive element at least under alkaline processing conditions, and (Link) represents a redox cleaving group, either being cleaved upon oxidation by development (negative type) or being prevented from cleaving thereby (positive type).

Examples of the negative type (Link) have been described in U.S. Pat. Nos. 4,135,929, 4,053,312 and 4,336,322, and Japanese Patent Application (OPI) Nos. 33826/73, 104343/76, 46730/78, 130122/79, 113624/76, 12642/81, 161131/81, 4043/82, 650/82, 20735/82, 54021/79 and 71072/81, and include N-substituted sulfamoyl groups (as substituents, aryl groups are preferred), but the present invention is not limited to these negative-type Link groups.

Examples of the (Ballast)-(Link)-groups which release a diffusible dye include the followings:

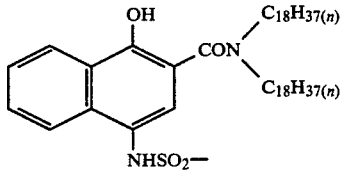

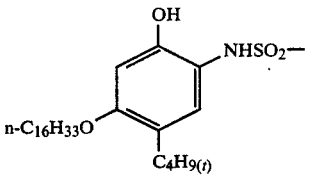

-continued

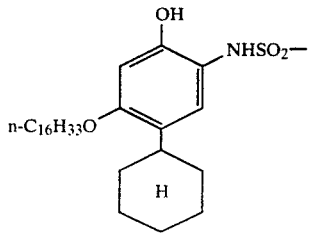

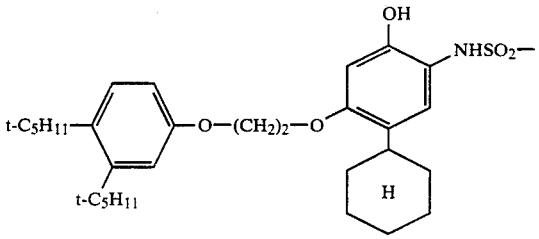

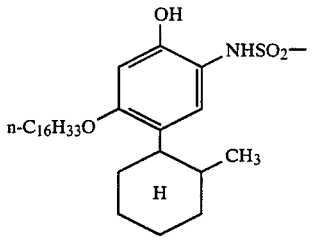

Examples of the positive type-(Link)-have been described in U.S. Pat. Nos. 4,199,354, 4,199,355, 4,139,379, 4,139,389, 3,719,489 and 4,098,783, Japanese Patent Application (OPI) Nos. 111628/74, 63618/76, 69033/78, 130927/79, 164342/81 and 4819/77 and Japanese Patent Application No. 60289/83 (corresponding to U.S. Ser. No. 597,623 filed on Apr. 6, 1984). Particularly preferred examples include the following compounds, but the present invention is not limited thereto.

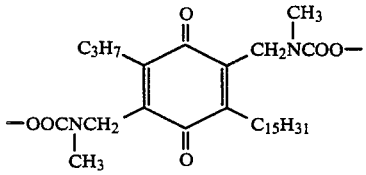

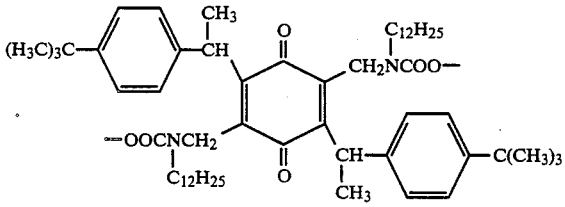

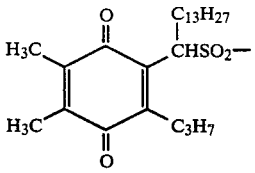

-continued

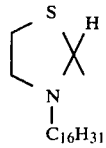

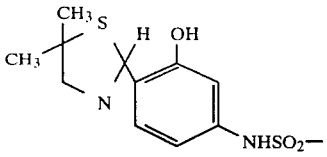

Of these positive type dye providing compounds, those having a quinone nucleus which releases a dye by reduction may be used in combination with antidiffusible electron donative compounds (known as ED compounds) or precursors thereof, such as ED compounds described in U.S. Pat. Nos. 4,263,393 and 4,278,750, and Japanese Patent Application (OPI) No. 138736/81.

If positive type dye providing compounds of the present invention are used, it is preferred to use them in combination with ED compounds.

Further, the positive type dye providing compounds may be those containing an electron donative group in the molecule which releases a dye by an intramolecular oxidation-reduction reaction.

Dyes released from the DRR compounds may be dyes or may be dye precursors capable of forming a dye in the photographic processing step or an additional processing step. The final image dyes may be either chelated with metal or not chelated. Typical dyes include azo dyes, azomethine dyes, anthraquinone dyes and phthalocyanine dyes, either chelated with metal or not chelated, and of these, azo type cyan, magenta and yellow dyes are particularly useful.

Examples of yellow dyes include those described in U.S. Pat. Nos. 3,597,200, 3,309,199, 4,013,633, 4,245,028, 4,156,609, 4,139,383, 4,195,992, 4,148,641, 4,148,643 and 4,336,322, Japanese Patent Application (OPI) Nos. 114930/76 and 71072/81, and *Research Disclosure* Nos. 17630 (1978) and 16475 (1977).

Examples of magenta dyes include those described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, and Japanese Patent Application (OPI) Nos. 106727/77, 23628/78, 36804/80, 73057/81, 71060/81 and 134/80.

Examples of cyan dyes include those described in U.S. Pat. Nos. 3,482,972, 3,929,760, 4,013,635, 4,268,625, 4,171,220, 4,242,435, 4,142,891, 4,195,994, 4,147,544 and 4,148,642, British Pat. No. 1,551,138, Japanese Patent Application (OPI) Nos. 99431/79, 8827/77, 47823/78, 143323/78, 99431/79 and 71061/81, European Pat. (EPC) Nos. 53,037 and 53,040, and *Research Disclosure* Nos. 17630 (1978) and 16475 (1977).

Further, DRR compounds incorporating dye group having a light absorption which is temporarily shifted can be used in the present invention as a dye precursor. Examples of such compound are described in Japanese Patent Application (OPI) Nos. 53330/80 and 53329/80, U.S. Pat. Nos. 3,336,287, 3,579,334 and 3,982,946 and British Pat. No. 1,467,317.

The amount of DRR compounds included is in a range of about $1\times10^{-4}$ to $1\times10^{-2}$ mole/m$^2$ and preferably about $2\times10^{-4}$ to $2\times10^{-3}$ mole/m$^2$.

In order to reproduce natural color by a subtractive process, light-sensitive materials having at least two emulsions having selective spectral sensitivity in certain wavelength ranges in combination with DRR compounds having selective spectral absorption in the same wavelength ranges are used.

Light-sensitive elements having a combination composed of a blue-sensitive silver halide emulsion and a yellow DRR compound, a combination composed of a green-sensitive emulsion layer and a magenta DRR compound and a combination composed of a red-sensitive emulsion layer and a cyan DRR compound are particularly useful. These combination units composed of the emulsion and the DRR compound may be applied in the form of layers so as to have a face-to-face relation in the light-sensitive material or may be applied as a mixture of grains (wherein the DRR compound and the silver halide grain are present in the same grain) so as to form one layer. Useful image receiving elements containing at least a mordanting layer, neutralizing layers or neutralization rate controlling layers (i.e., timing layers), reflection layers, light-shielding layers and cover sheets, are described in U.S. Pat. No. 4,268,625.

Polymeric mordanting agents used in the mordanting layer are polymers containing secondary and tertiary amino groups, polymers having nitrogen containing heterocyclic groups or polymers containing quaternary cation groups, which have a molecular weight of about 5,000 or more and preferably about 10,000 or more.

Examples of the polymeric mordanting agent include a vinyl pyridine polymer and a vinyl pyridium cation polymer as described in U.S. Pat. Nos. 2,548,564, 2,484,430, 3,148,061, 3,756,814, or etc.; a polymeric mordanting agent capable of being cross-linked with gelatin, or etc. as described in U.S. Pat. Nos. 3,625,694, 3,859,096 and 4,128,538, British Pat. No. 1,277,453, or etc.; an aqueous sol type mordanting agent as described in U.S. Pat. Nos. 3,958,995, 2,721,852 and 2,798,063, Japanese Patent Application (OPI) Nos. 115228/79, 145529/79 and 126027/79, or etc.; a water-insoluble mordanting agent as described in U.S. Pat. No. 3,898,088; a reactive mordanting agent capable of being covalently bonded with a dye as described in U.S. Pat. No. 4,168,976 (corresponding to Japanese Patent Application (OPI) No. 137333/79), or etc.; and a mordanting agent as described in U.S. Pat. Nos. 3,709,690, 3,788,855, 3,642,482, 3,488,706, 3,557,066, 3,271,147, and 3,271,148, and Japanese Patent Application (OPI) Nos. 71332/75, 30328/78, 155528/77, 125/78 and 1024/78.

The processing composition used in the present invention is preferred contained in a container capable of rupturing by application of pressure. Those described in U.S. Pat. Nos. 2,543,181, 2,643,886, 2,653,732, 2,723,051, 3,056,491, 3,056,492 and 3,152,515 are preferred.

The photographic film units of the present invention are constructed so that photographic processing can be carried out by passing the film unit between a pair of parallel press members after it is imagewise exposed to light.

In a most preferred embodiment of the present invention, an image receiving layer, a light reflection layer which substantially shields light (for example, a combination of a $TiO_2$ layer and a carbon black layer) and one or more of the above described light-sensitive layers (light-sensitive element) are applied in this order to a transparent support, and a transparent cover sheet is superimposed in a face-to-face relation. A rupturable container which contains an alkali processing solution containing a light-shielding agent (for example, carbon black) and an aluminum compound for preventing post-transfer is placed adjacent to the uppermost layer of said light-sensitive layer (i.e., protective layer) and the transparent cover sheet. Such a film unit is exposed to light through the transparent cover sheet, and the container is ruptured by a press member upon being removed from the camera to spread the opaque processing composition between the uppermost layer and the cover sheet. Thus, the light-sensitive layer is protected from exposure to light during development, which progresses in the light.

A neutralizing mechanism is incorporated in the film unit of the present invention, and it is particularly preferred to provide a neturalizing layer in the cover sheet. If desired, a timing layer provided on the side of the nutralizing layer closer to spread of the processing solution.

In another embodiment of the invention, the light-sensitive sheet comprises a support, a neutralizing layer, a timing layer, a mordanting layer and silver halide emulsion layers associated with DRR compounds.

In the film units of the present invention, the part containing the image receiving layer (color print) may be separated from the part containing the light-sensitive layer, although this separation is optional.

The present invention is explained in greater detail by reference to the following examples, but the present invention is not to be construed as being limited thereto. Unless otherwise indicated, all parts, percents and ratios are by weight.

EXAMPLE 1

A light-sensitive material was produced by applying the following layer to a transparent polyethylene terephthalate film support.

(1) A mordanting layer containing 3.0 g/m$^2$ of copoly(styrene-N-vinylbenzyl-N,N,N-trihexylammonium chloride) (not ratio 10:90) and 3.0 g/m$^2$ of gelatin.

(2) A light reflection layer containing 20 g/m$^2$ of titanium dioxide and 2.0 g/m$^2$ of gelatin.

(3) A light shielding layer containing 3.0 g/m$^2$ of carbon black and 2.0 g/m$^2$ of gelatin.

(4) A layer containing a cyan dye releasing redox compound having the following structure (0.44 g/m$^2$), tricyclohexyl phosphate (0.09 g/m$^2$) and gelatin (0.8 g/m$^2$).

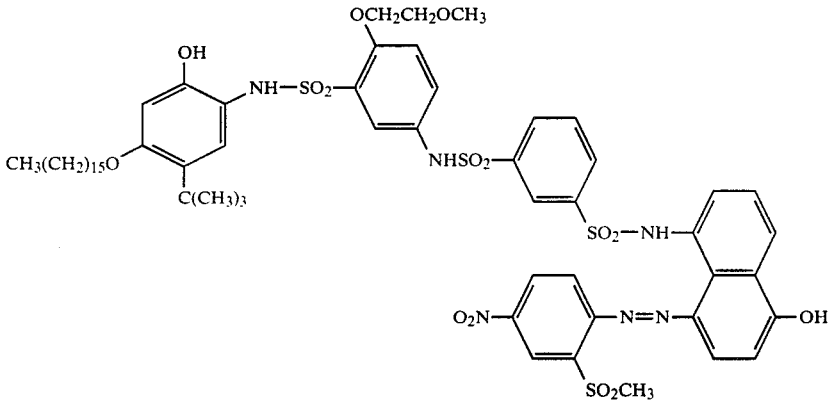

(5) A layer containing a red-sensitive inner latent image type direct reversal silver bromide emulsion (silver content: 1.03 g/m$^2$, gelatin: 1.2 g/m$^2$), a nucleating agent having the following structure (0.05 mg/m$^2$) and 2-sulfo-5-n-pentadecylhydroquinone sodium salt (0.13 g/m$^2$).

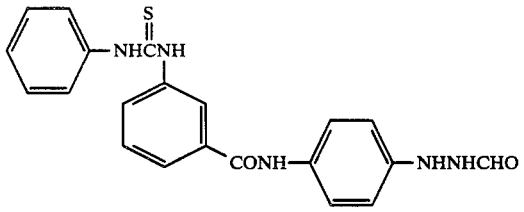

(6) A color stain preventing layer containing gelatin (0.8 g/m$^2$), 2,5-di-t-pentadecylhydroquinone (1.0 g/m$^2$) and polymethyl methacrylate (1.0 g/m$^2$).

(7) A layer containing a magenta dye releasing redox compound having the following structure I (0.21 g/m$^2$), a magenta dye releasing redox compound having the following structure II (0.11 g/m$^2$), tricyclohexyl phosphate (0.08 g/m$^2$) and gelatin (0.9 g/m$^2$).

Structure I

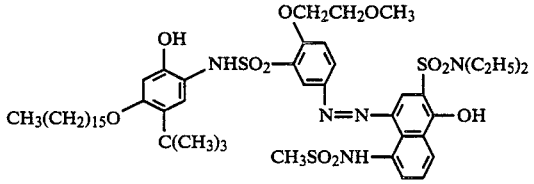

Structure II

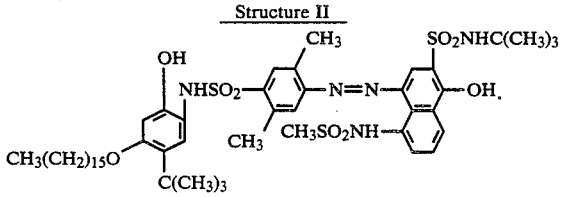

(8) A layer containing a green-sensitive inner latent image type direct reversal silver bromide emulsion (silver content: 0.82 g/m$^2$, gelatin: 0.9 g/m$^2$), the same nucleating agent as in layer (5) (0.03 mg/m$^2$) and 2-sulfo-5-n-pentadecylhydroquinone sodium salt (0.08 g/m$^2$).

(9) The same layer as layer (6).

(10) A layer containing a yellow dye releasing redox compound having the following structure (0.53 g/m$^2$), tricyclohexyl phosphate (0.13 g/m$^2$) and gelatin (0.7 g/m$^2$).

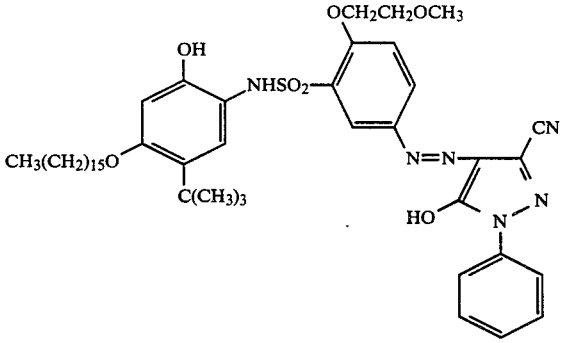

(11) A layer containing a blue-sensitive inner latent image type direct reversal silver bromide emulsion (silver content: 1.09 g/m$^2$, gelatin: 1.1 g/m$^2$), the same nucleating agent as in layer (5) (0.04 mg/m$^2$) and 2-sulfo-5-n-pentadecylhydroquinone sodium salt (0.07 g/m$^2$).

(12) A layer containing gelatin (1.0 g/m$^2$),

A cover sheet was produced by applying the following layers (1')-(3') to a transparent polyester support in the order indicated.

(1') A layer containing an 80:20 (ratio by weight) copolymer of acrylic acid and butyl acrylate (22 g/m$^2$) and 1,4-bis(2,3-epoxypropoxy)butane (0.44 g/m$^2$).

(2') A layer containing acetyl cellulose (100 g of acetyl cellulose was hydrolyzed to form 39.4 g of acetyl group) (3.8 g/m$^2$), a 60:40 (ratio by weight) copolymer of styrene and maleic acid anhydride (molecular weight: about 50,000) (0.2 g/m$^2$) and 5-($\beta$-cyanoethylthio)-1-phenyltetrazole (0.115 g/m$^2$).

(3') A layer containing an 85:12:3 (ratio by weight) copolymer latex of vinylidene chloride, methyl acrylate and acrylic acid (2.5 g/m$^2$) and polymethyl methacrylate latex (particle size: 1–3 $\mu$m) (0.05 g/m$^2$).

Alkali processing compositions having the following formulations were prepared.

Processing composition A:

| | |
|---|---|
| 1-p-Tolyl-4-Hydroxymethyl-4-Methyl-3-Pyrazolidinone | 12 g |
| Methylhydroquinone | 0.3 g |

-continued

| | |
|---|---|
| 5-Methylbenzotriazole | 3.5 g |
| Sodium Sulfite (anhydrous) | 0.2 g |
| Carboxymethyl Cellulose Na salt | 43 g |
| Potassium Hydroxide | 56 g |
| Benzyl Alcohol | 1.5 ml |
| Carbon Black | 150 g |
| Water to make | 1 kg |

Processing composition B:

The same formulation as that of processing composition A, except that 20 g of $Al(NO_3)_3.9H_2O$ was added and 20 g of water was omitted.

Processing composition C:

The same formulation as that of processing composition A, except that 20 g of sodium aluminate was added and 20 g of water was omitted.

In order to compare the samples, the above described light-sensitive sheet was imagewise exposed to light by applying light of 4800° K. which was obtained by passing tungsten light of 2854° K. through a Davis Gibbson's filter to the transparent support side of the light-sensitive layer through a continuous wedge (maximum exposure in this case was 10 CMS). The exposed light-sensitive sheet was integrated with the container containing the above described processing composition and the cover sheet, and the processing solution was spread by means of a pressing member at 25° C. After 1 hour, 1 day and 1 week, transfer dye density was measured by a color densitometer. An increase of density after 1 day and 1 week based on the density after 1 hour was evaluated in the maximum density area. Results are shown in Table 1.

TABLE 1

| | (Comparison) Processing composition A Δ Dmax | | | (The present invention) B Δ Dmax | | | (The present invention) C Δ Dmax | | |
|---|---|---|---|---|---|---|---|---|---|
| | Y | M | C | Y | M | C | Y | M | C |
| After 1 day | +0.06 | +0.15 | +0.09 | +0.02 | +0.07 | +0.04 | +0.03 | +0.08 | +0.06 |
| After 1 week | +0.08 | +0.18 | +0.15 | +0.03 | +0.09 | +0.07 | +0.04 | +0.10 | +0.08 |

Note

Δ Dmax is the value obtained by subtracting Dmax after 1 hour from Dmax after 1 day or 1 week.

Y, M and C represent yellow density, magenta density and cyan density, respectively.

It is understood from the results shown in Table 1 that the increase of dye desnities observed after one day and one week is remarkably lower using processing compositions B and C containing the aluminum compound according to the invention as compared with the comparative processing composition A and that photographs having superior quality are produced using the film unit according to the invention.

While the invention has been described in detail and with reference to specific embodiment thereof, it will be apparent to one skilled in the art that various changes and modifications can be made therein without departing from the spirit and scope thereof.

What is claimed is:

1. A nonseparation monosheet integrated type color diffusion transfer photographic film unit comprising (a) a light-sensitive element comprising a support having provided thereon in this order an image receiving layer, a white reflection layer and at least one silver halide emulsion layer associated with a dye providing compounds capable of forming or releasing a diffusible dye as a result of development;

(b) a cover sheet;

(c) at least one neutralizing layer; and (d) a container provided between the emulsion layer of the light-sensitive element and the cover sheet, containing a filter agent-free alkali processing composition which contains an aluminum compound which produces aluminic acid anions in the alkali processing composition having a high pH value, but produces aluminum cations with the neutralization of alkali.

2. The film unit claimed in claim 7, wherein said aluminum compound is present in an amount of from about 0.4 to 40 g per kg of alkali processing composition.

3. The film unit claimed in claim 2, wherein said aluminum compound is present in an amount of from about 1.0 to 20 g per kg of alkali processing composition.

4. The film unit claimed in claim 1, wherein said neutralizing layer is present in said cover sheet.

5. The film unit claimed in claim 1, wherein said neutralizing layer is present between the base of said light-sensitive element and said image-receiving layer.

* * * * *